US006084552A

United States Patent [19]

Robertson et al.

[11] Patent Number: 6,084,552

[45] Date of Patent: Jul. 4, 2000

[54] OMNIDIRECTIONAL RADIOFREQUENCY ANTENNA WITH CONICAL REFLECTOR

[75] Inventors: Duncan A Robertson; Peter B May, both of Fife, United Kingdom

[73] Assignee: The Secretary of State for Defence in Her Britannic Majesty's Goverment of the United Kingdom of Great Britain and Northern Ireland, Farnborough, United Kingdom

[21] Appl. No.: 09/117,268

[22] PCT Filed: Feb. 5, 1997

[86] PCT No.: PCT/GB97/00311

§ 371 Date: Jul. 27, 1998

§ 102(e) Date: Jul. 27, 1998

[87] PCT Pub. No.: WO97/29525

PCT Pub. Date: Aug. 14, 1997

[30] Foreign Application Priority Data

Feb. 6, 1996 [GB] United Kingdom ..... 9602395

[51] Int. Cl.[7] ..... H01Q 19/06; H01Q 19/10

[52] U.S. Cl. ..... 343/753; 343/755; 343/756

[58] Field of Search ..... 343/753, 754, 343/755, 756, 786; 356/247, 172, 153; 385/124, 127; 369/44; 250/353, 393

[56] References Cited

U.S. PATENT DOCUMENTS

| | | | |
|---|---|---|---|
| 2,045,398 | 6/1936 | Massey et al. | 343/838 |
| 4,111,564 | 9/1978 | Trice | 356/247 |
| 4,581,529 | 4/1986 | Gordon | 250/227 |
| 5,115,486 | 5/1992 | Bader et al. | 385/124 |

FOREIGN PATENT DOCUMENTS 678930 10/1995 European Pat. Off. .

1616252 3/1971 Germany .

OTHER PUBLICATIONS

Optical and Quantum Electronics, vol. 24, 1992, pp. S951–S962, XP000195853, N.R. Heckenberg et al: "Laser beams with phase singularities" cited in the application, see p. S961, Paragraph 4.

Optics Communications, vol. 96, 1993, pp. 123–132, XP000195858, M.W. Beijersbergen et al: "Astigmatic laser mode converters and transfer of orbital angular momentum", cited in the application, see abstract.

Optics Communications, vol. 112, No. 5/6, Dec. 1, 1994, pp. 321–327, XP000474724, M.W. Beijersbergen et al: "Helical–wavefront laser beams produced with a spiral phaseplate" cited in the application, see the whole document.

Optical Communications, vol. 127, Jun. 15, 1996, pp. 183–188, XP000195860, G.A. Turnbull et al: "The generation of free–space Laguerre–Gaussian modes at millimetre–wave frequencies by use of spiral phaseplate" cited in the application, see the whole document.

IEE Proceedings, vol. 131, No. 4, Aug. 4, 1984, pp. 258–262, XP000195855, R.J. Wyde: "Millimetre–wave Gaussian beam–mode optics an corrugated feed horns" cited in the application, see p. 262, left–hand column.

Patent Abstract of Japan, vol. 13, No. 46 (E–711), Feb. 2, 1989 & JP 63 240202 A (NEC CORP), Oct. 5, 1988, see abstract.

*Primary Examiner*—Tan Ho

*Attorney, Agent, or Firm*—Nixon & Vanderhye P.C.

[57] ABSTRACT

An antenna system for providing radiation over substantially 360° in azimuth by illuminating a conical reflector with a radiation beam having a frequency distribution with a local minimum which is coincident with the point of the reflector thus avoiding scattering. Preferably the radiation intensity distribution is annular, most preferably being Laguerre-Gaussian in nature.

11 Claims, 7 Drawing Sheets

(a)

(b)

OMNIDIRECTIONAL RADIOFREQUENCY ANTENNA WITH CONICAL REFLECTOR

BACKGROUND OF THE INVENTION

The present invention concerns an antenna for radiofrequency (r.f.) transmission.

2. Discussion of Prior Art

The requirement for an antenna which provides transmission covering 360° in azimuth is well known in, for example, combat identification systems where combat vehicles etc need to transmit a signal which allows them to be identified by friendly forces. The applicability of the current invention is not, however, restricted to this field and uses may be found in any situation where transmission covering an azimuth of 360° is required, for example, in the area of local area networking where a number of peripheral devices may communicate by r.f. transmission rather than electrical or fibre optic link.

Several types of reflector antenna are known (see for example Kraus, J. D., *Antennas,* McGraw-Hill, 2nd Ed., 1988.). Conventionally, the reflector is used to direct or focus the energy into a narrow beam, but if the application requires an omnidirectional antenna pattern, then the reflector needs to spread the energy into a wide angle. This has been achieved using a dual reflector system using a parabolic subreflector (Orefice, M. & Pirinoli, P., "Dual reflector antenna with narrow broadside beam for omnidirectional coverage", *Elec. Lett.,* Vol. 29, No. 25, Dec. 9, 1993, pp. 2158–2159.). If just a single reflector is preferred, one can use, for example, a beam having a fundamental Hermite-Gaussian radial intensity to illuminate a cone which reflects the radiation over 360° in azimuth. However, a beam having such a radial intensity to illuminate has its maximum intensity illuminating the point of the cone and this causes scattering and interference which, in turn, causes high sidelobes and a ragged elevation pattern. Such a design is also difficult to model accurately.

SUMMARY OF THE INVENTION

Therefore, in a first aspect of the present invention there is provided a method of transmitting radiofreaquency radiation over an azimuth angle of substantially 360° which is characterised by illuminating a substantially conical reflector with a beam having a Laguerre-Gaussian intensity distribution, the minimum of the Laguerre-Gaussian distribution coinciding with the apex of the reflector, and the arrangement of the beam and relector being such that the radiation reflected from the reflector is divergent.

The term substantially, conical, when used in this specification, is intended to be construed in a broad sense where, in addition to the case of a perfect cone within the strictest meaning, other cases where reflection over 360° in azimuth is provided are included. Such cases would include structures based on a cone shape but with sides which are convex or concave.

According to a second aspect of the invention, an radiofreaquency antenna for providing transmission over substantially 360° in azimuth comprises a conical reflector and means for illuminating said reflector with a beam having a Laguerre-Gaussian intensity distribution, the minimum of the Laguerre-Gaussian distribution coinciding with the apex of the reflector, and the arrangement of the beam and the reflector being such that the radiation reflected from the reflector is divergent.

A further preferred embodiment includes a source of radiation having a Fundamental Hermnite-Gaussian intensity distribution and means for converting said radiation to radiation having a Laguerre-Gaussian intensity distribution.

The means for converting radiation having a Fundamental Hermite-Gaussian intensity distribution may comprise a spiral phaseplate. A further preferred embodiment includes means for collimating the radiation having a Fundamental Hermite-Gaussian intensity distribution.

The means for collimating the radiation having a Fundamental Hermite-Gaussian intensity distribution may comprise at least one lens.

A further preferred embodiment includes means for controlling the angular coverage in elevation of the output radiation of the antenna.

The means for controlling the angular coverage m elevation of the output radiation of the antenna may comprise at least one lens.

In a further embodiment the radiation having a Fundamental Hermite-Gaussian intensity distribution is linearly polarised.

A further preferred embodiment includes means for converting said linearly polarised radiation to circularly polarised radiation.

The means for converting said linearly polarised radiation to circularly polarised radiation may comprise a quarter wave plate.

BRIEF DESCRIPTION OF THE DRAWINGS

The invention will now be described, by way of example only, with reference to the following figures in which.

DETAILED DESCRIPTION OF PREFERRED EMBODIMENTS

Figure 1A:
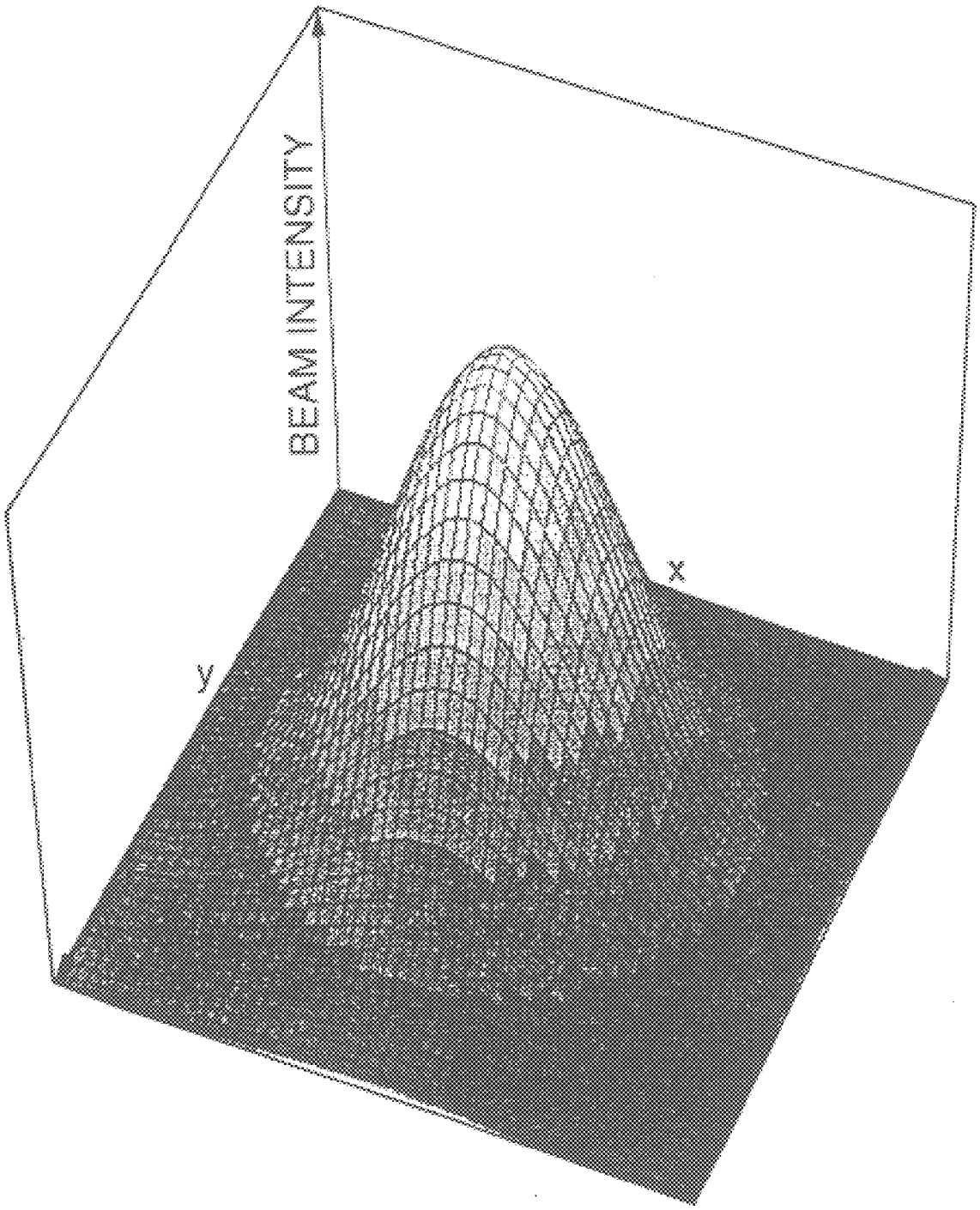
FIGS. 1*a* and 1*b* respectively show radiation intensity, in two dimensions, of beams having a Fundamental Hermite-Gaussian intensity distribution and a Laguerre-Gaussian intensity distribution.
Figure 1B:
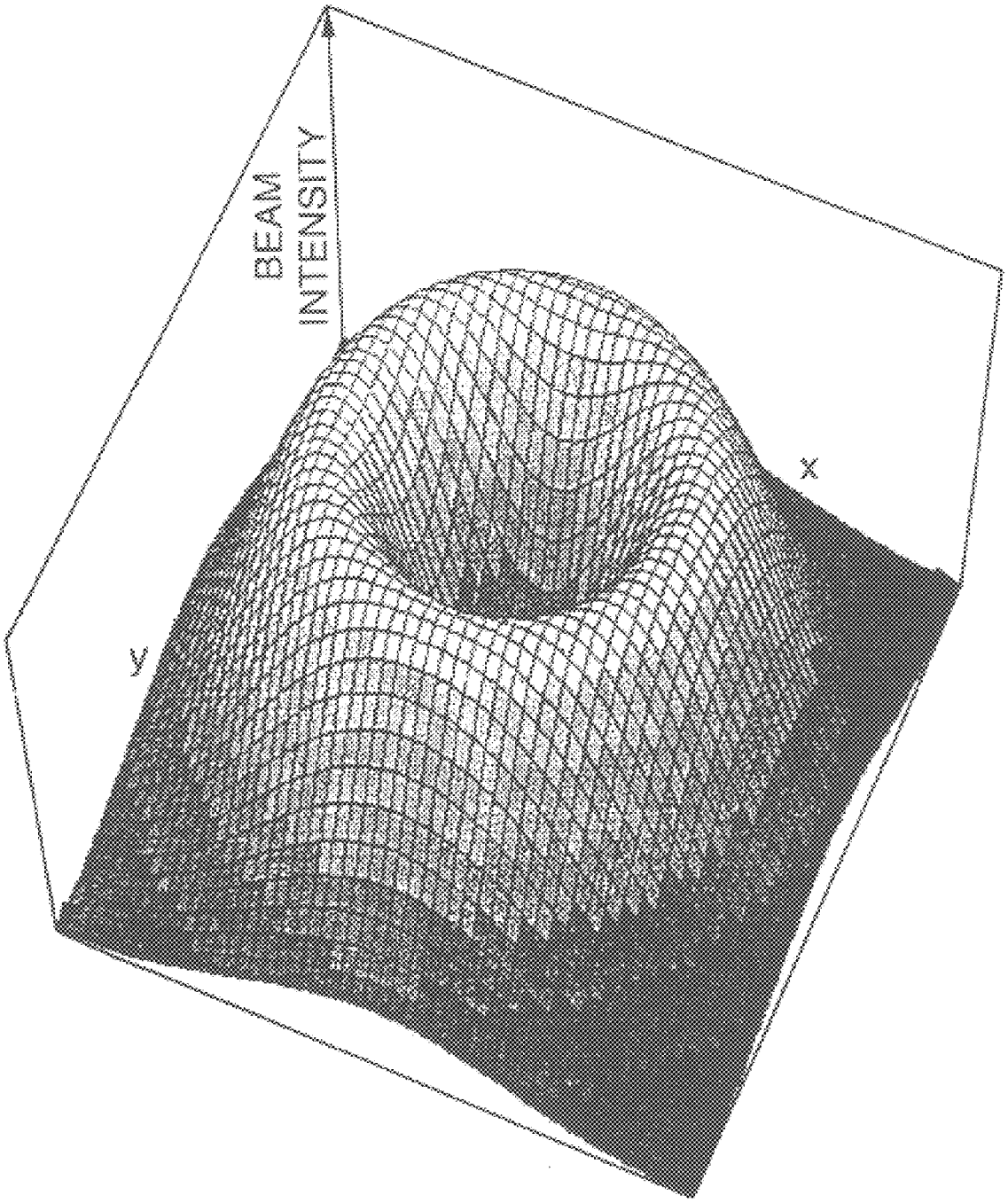

Referring to FIG. 1*a,* radiation having a Fundamental Hermite-Gaussian intensity distribution has a local maximum in intensity at the centre of the beam. Such radiation is converted to radiation having a Laguerre-Gaussian intensity distribution (FIG. 1*b*) on passing through a spiral phaseplate as will be described later. The latter radiation has a local minimum in intensity at its centre. (The value of intensity at this local minimum is zero, thus defining a null).

Figure 2:
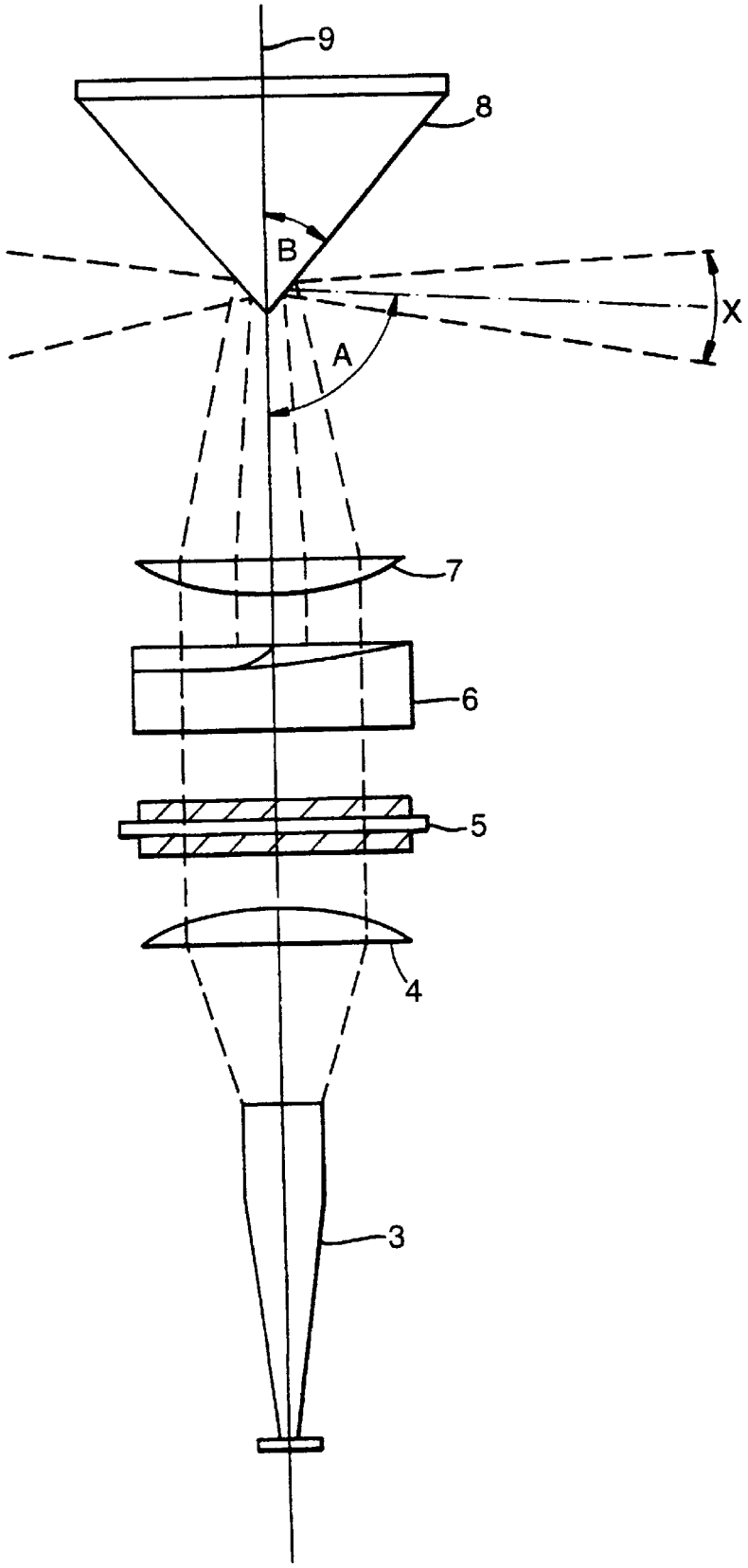
FIG. 2 shows a schematic representation of a typical antenna of the invention.

Referring to FIG. 2, radiation is represented by the broken lines. Linearly polarised radiation having a Fundamental Hermite-Gaussian intensity distribution is supplied via a corrugated feedhorn 3. This radiation is diverging until it reaches collimating lens 4. The collimated radiation passes through quarter wave plate 5 which converts it to circularly polarised radiation. The circularly polarised radiation then passes through spiral phaseplate 6 which converts its intensity distribution to a Laguerre-Gaussian mode. The radiation then passes through lens 7 to illuminate conical reflector 8 which reflects the radiation over substantially 360°. The Laguerre-Gaussian radiation has a null at the centre of the beam which is coincident with the point of the conical reflector. Thus scattering is avoided.

During operation, the axis 9 of the antenna is vertical so that the reflection of radiation over 360° gives rise to an antenna with a transmission azimuth of that angle. The nominal elevation angle A of the transmission (i.e. the angle of the maximum intensity of the transmitted radiation) is mainly determined by the angle B of the cone. The choice of lens 7 determines the spread X of the transmitted elevation.

Figure 3:
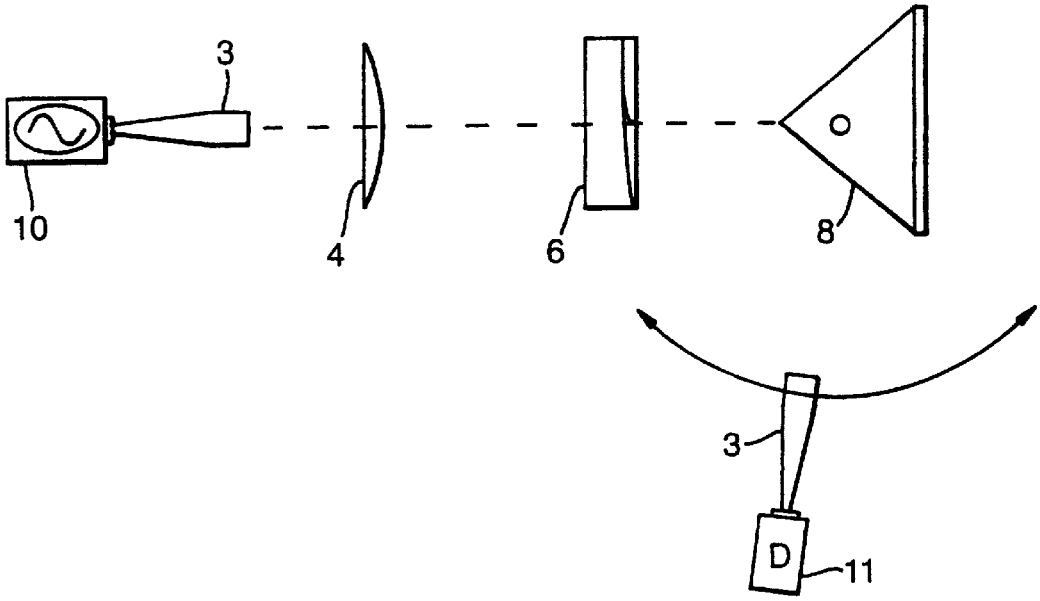
FIGS. 3 shows an actual embodiment of the invention.

Referring to FIG. 3 the radiation source 10 was an InP Gunn oscillator. The output was coupled from the WG27 waveguide (not shown) of the oscillator into free space through a corrugated scalar feedhorn 3 which produced a vertically polarised fundamental Hermite-Gaussian mode beam with a beam waist of 4.2 mm.

The free space beam was collimated with an 88 mm diameter, high density polyethylene (HDPE) planar-convex lens 4, which had an input focal length of 100 mm and an output focal length of 320 mm.

The fundamental Hermite-Gaussian mode beam was converted to a second order Laguerre-Gaussian mode beam using a spiral phaseplate 6 machined from HDPE. The phaseplate had a diameter of 88 mm and a step height of 13.4 mm. The spiral phaseplate was located 360 mm from the planar surface of lens 4.

The Laguerre-Gaussian mode beam fell incident on an aluminium conical reflector 8, located 720 mm from the planar surface of lens 4. The cone had a diameter of 100 mm and a half-angle of 47 degrees.

The reflected power was collected using a Boonton 4220 power meter II having a WG27 sensor head (not shown), which was swept in an arc through the horizontal plane, pivoting about a point 25 mm behind the apex of the cone. The power sensor was fitted with another corrugated scalar feedhorn 3 similar to that used on the oscillator. The distance from the pivot point to the feedhorn beamwaist was 250 mm.

Figure 4:
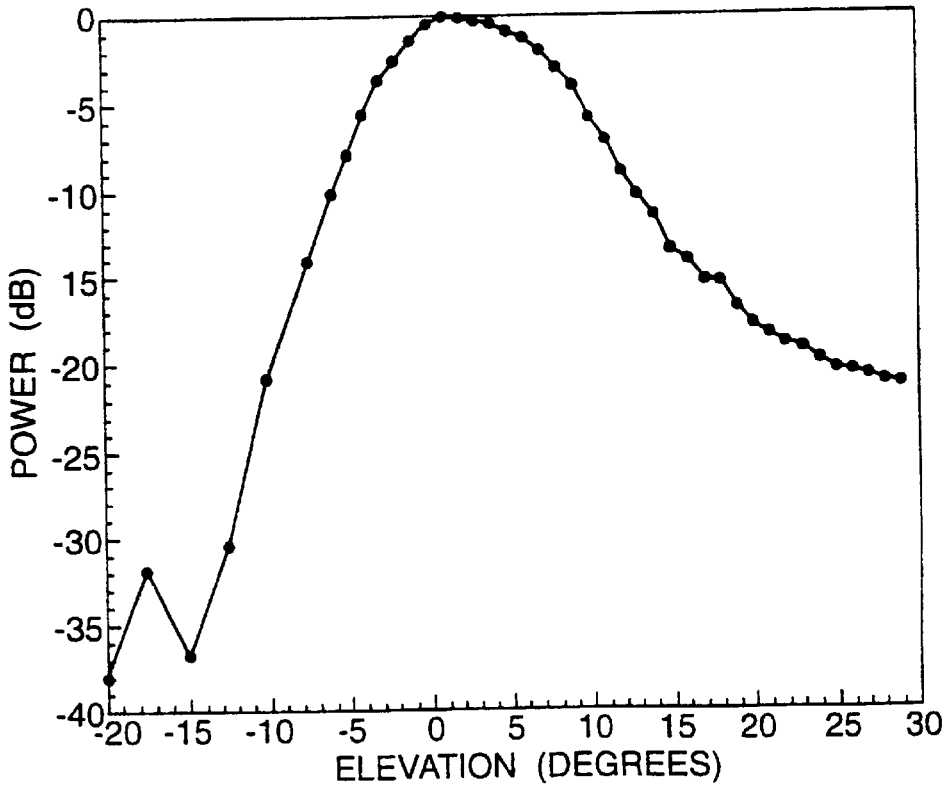
FIG. 4 shows the variation of reflected radiation power with elevation angle for a particular embodiment of the invention.

Power measurements were recorded for incremental angular positions of the detector and the results are presented in FIG. 4 which illustrates excellent sidelobe performance at negative elevation angles and the general smoothness of th e response Leakage round the top of the cone limits the response to about −20 dB at large positive angles, but this could be remedied by placing absorber round the top of the cone.

The angular coverage is relatively narrow since the beam was not focused down onto the tip of the cone. Doing so would give a more divergent beam and consequently a greater angular spread in elevation.

The experiment was performed with vertical polarisation for simplicity but the addition of a quarter-wave plate (item 5 of FIG. 3) to give circular polarisation would be straightforward.

Figure 5A:
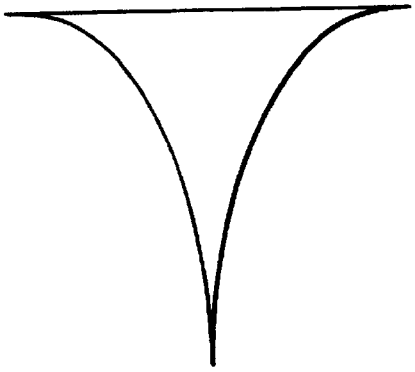
FIG. 5*a* and 5*b* show variations of the shape of reflector which might be used in the current invention.
Figure 5B:
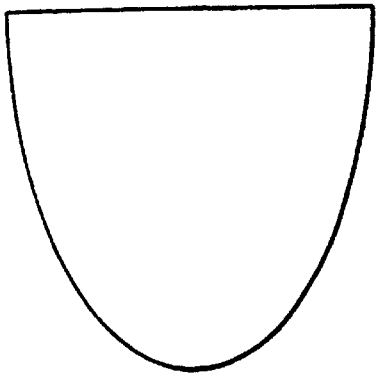

Although conical reflectors are used in the examples illustrated, other reflector shapes, which provide reflection over 360° in azimuth may be used. Such variations might include a convex variation on the cone shape (FIG. 5*a*) or a concave variation (FIG. 5*b*).

Generation of Free-Space Laguerre-Gaussian Modes

Figure 6:
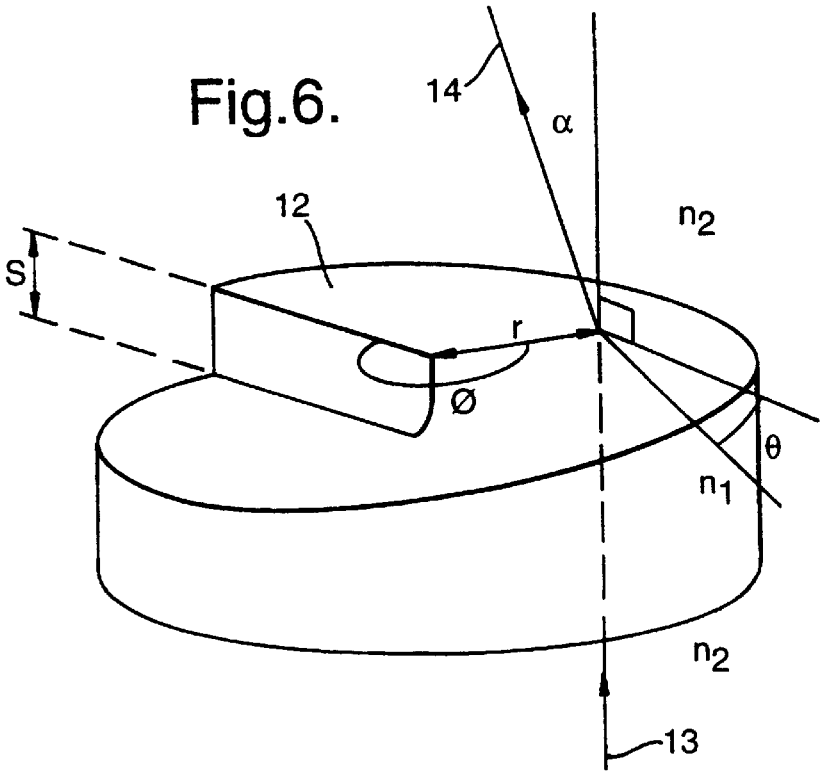
FIG. 6 shows a spiral phaseplate, showing the refraction of a single ray upon transmission.
Figure 8:
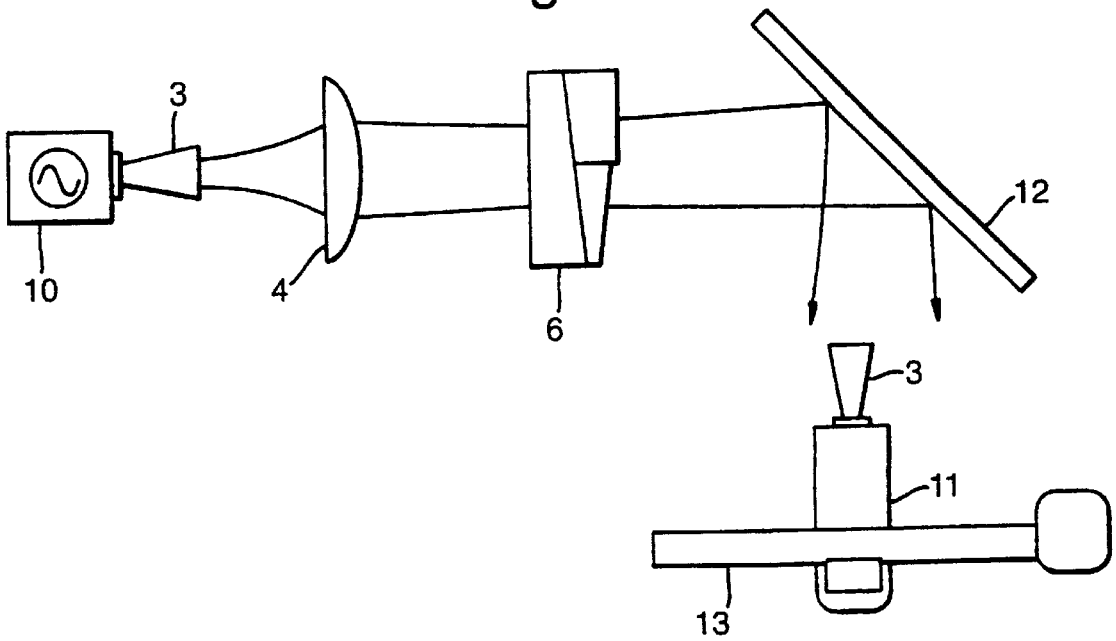
FIG. 8 shows an experimental configuration for obtaining Laguerre-Gaussian modes at millimeter-wave frequencies and FIGS. 9(*a*) and 9(*b*) shows far-field intensity distributions for observed Laguerre-Gaussian modes $LG_0^1$ and $LG_0^2$ respectively.
Figure 9:
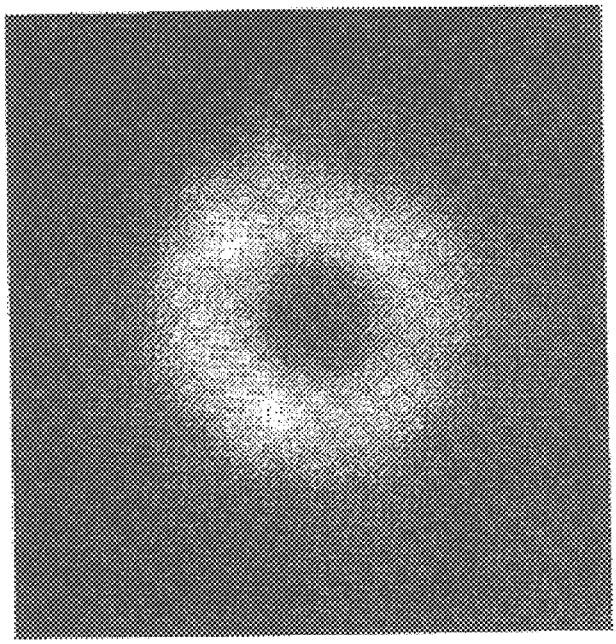
Figure 9:
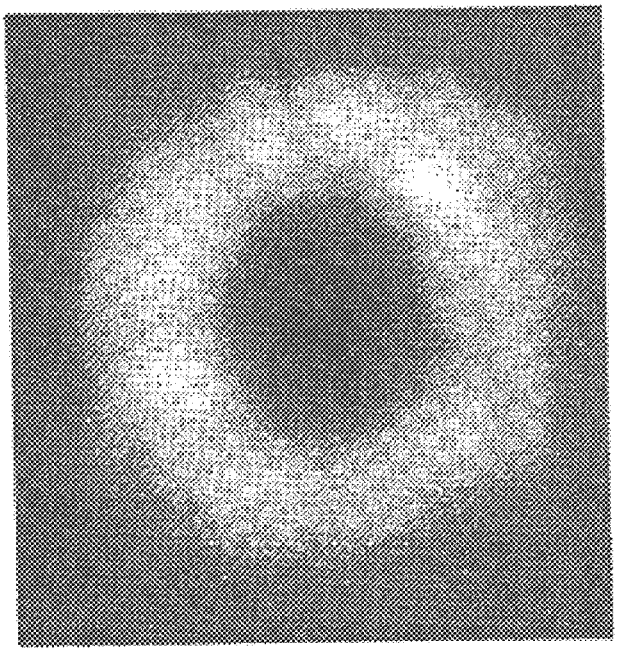

The following section, along with FIGS. 6, 8 and 9 is Reprinted from Optics Communications, 127 (1996), Tumbull, Robertson, Smith, Allen and Padgett, "The generation of free-space Laguerre-Gaussian modes at millimeter-wave frequencies by use of a spiral phaseplate", pp 183–188, © 1996 with kind permission from Elsevier Science-NL, Sara Burgerhartstraat 25, 1055 KV Amsterdam, The Netherlands.

Laguerre-Gaussian (LG) modes, like Hermite-Gaussian (HG) modes, form a complete basis set for paraxial light beams. The former exhibit circular symmetry, the latter rectangular. Two indices identify a given mode, and the modes are normally denoted $LG_p^l$ and $HG_{mn}$. For a Hermite-Gaussian mode m and n are the numbers of nodes in the x and y directions respectively. For a Laguerre-Gaussian mode, l is the number of 2π cycles in phase around the circumference and (p+1) the number of radial nodes. The amplitude, $u_p^l$ of the $LG_p^l$ mode in cylindrical co-ordinates is $$u_p^l(r,\phi,z)\, e^{-ikr^2/2R} e^{-r^2} e^{-r^2/w^2} e^{-i(2p+l+1)\psi - il\phi} (-1)^p (r\sqrt{2}/w)^l L_p^l(2r^2/w^2), \tag{1}$$

where R is the wavefront radius of curvature, w is the radius for which the Gaussian term falls to 1/e of its on-axis value, ψ is the Gouy phase and $L_p^l(x)$ a generalised Laguerre polynomial. The azimuthal phase term, $e^{il\Phi}$, distinguishes the Laguerre-Gaussian modes from the Hermite-Gaussian modes. This phase term creates helical wavefronts for the Laguerre-Gaussian modes in contrast to the planar wavefronts of the Hermite-Gaussian modes (see J. M. Vaughan and D. V. Willetts, Optics Comm. 30 (1979)263). Angular momentum is associated with these helical wavefronts which is termed orbital angular momentum and is distinguished from the spin angular momentum associated with the polarisation state. It has been shown that a pure Laguerre-Gaussian beam has an orbital angular momentum equivalent to l h per photon (See L. Allen, M. W. Beijersbergen, R. J. C. Spreeuw and J. P. Woerdman, Phys. Rev. A 45 (1992)8185).

The angular momentum content of these Laguerre-Gaussian beams has been recently demonstrated through an optical interaction with microscopic particles (H. He, M. E. J. Friese, N. R. Heckenberg and H. Rubinsztein-Dunlop, Phys. Rev. Lett. 75 (1995)826).

In recent years, the production of Laguerre-Gaussian modes at optical frequencies has attracted considerable interest. Laguerre-Gaussian laser beams may be produced directly (M. Harris, C. A. Hill and J. M. Vaughan, Optics Comm. 106 (1994)161), or by the conversion of Hermite-Gaussian modes. To date, three different classes of mode converter have been demonstrated. Two of these, spiral phaseplates (M. W. Beijersbergen, R. P. C. Coerwinkel, M. Kristensen and J. P Woerdman, Optics Comm. 112 (1994) 321) and computer generated holographic converter (N. R. Heckenberg, R. McDuff, C. P. Smith and A. C. White, Optics Lett, 17 (1992)221; N. R. Heckenberg, R. McDuff, C. P. Smith, H. Rubinsztein-Dunlop and M. J. Wegener, Opt. and Quant. Elec. 24 (1992)S951), introduce the azimuthal phase term to a $HG_{00}$ beam. In these devices a screw phase-dislocation, produced on axis, causes destructive interference, leading to the characteristic ring intensity pattern in the far field. The spiral phaseplate may also be used to convert between any two $LG_p^l$ modes separated by an $e^{il\Phi}$ phase term. In general, the purity of Laguerre-Gaussian modes produced by these methods is limited by the co-production of higher order modes.

The other class of converter is the cylindrical-lens mode converter (M. W. Beijersbergen, L. Allen H.E.L.O. van der Veen and J. P. Woerdman, Optics Comm. 96 (1993)123) which converts higher order Hermite-Gaussian modes to the corresponding Laguerre-Gaussian mode. Unlike the spiral phaseplate and the holographic converter, this method can produce pure Laguerre-Gaussian modes.

For a Laguerre-Gaussian mode, the orbital angular momentum in the beam is equivalent to l h per photon. Consequently, for a fixed power, the angular momentum in the beam is proportional to the wavelength; unlike linear momentum, $h/\lambda$ per photon, where for a fixed power the linear momentum in the beam is wavelength independent.

The production of free-space, Laguerre-Gaussian modes, to millimeter-wave frequencies (~100 GHz), where the wavelength is $\sim 10^4$ times that at optical frequencies will be extended herein. Hence, for the same power, the orbital angular momentum is also $\sim 10^4$ times larger, which opens the possibility for observing the transfer of angular momentum to a macroscopic object. The use of a spiral phaseplate to convert the fundamental Hermite-Gaussian to higher order Laguerre-Gaussian modes will be demonstrated. The phaseplate is preferable to the cylindrical lens converter because of the relative difficulty of producing high order freespace, Hermite-Gaussian beams at millimeter-wave frequencies.

The total angular momentum, $J_Z$, of a Laguerre-Gaussian beam is the sum of orbital and spin angular momenta (L. Allen, M. W. Beijersbergen, R. J. C. Spreeuw and J. P. Woerdman, Phys. Rev. A 45 (1992)8185. Thus for left-hand or right-hand circularly polarised beams $J_Z=l\pm1$. The Hermite-Gaussian mode converted in this work has a well-defined linear polarisation and consequently the total angular momentum in the beam is due entirely to orbital angular momentum.

Ray Optics Analysis of a Spiral Phaseplate Mode Converter

The spiral phaseplate (FIG. 6) has one planar surface (not shown) and one spiral surface 12.

The spiral surface 12 forms one period of a helix, with a step discontinuity. Upon transmission through the phaseplate, an incident ray 13 gives rise to a refracted ray 14 where the angle of refraction is $\alpha$. A beam of wavelength $\lambda$ is subject to a phase delay, $\psi$, which depends on the azimuthal angle, $\phi$, where $$\psi = \frac{(n_1 - n_2)s}{\lambda}\phi \tag{2}$$

$n_1$ and $n_2$ are the refractive indices of the phaseplate and surrounding media respectively and s is the physical step height at $\phi=0$.

For a Laguerre-Gaussian mode, the total phase delay around the phaseplate must be an integer multiple of $2\pi$, i.e. $2\pi l$. Thus, to produce a Laguerre-Gaussian mode, the physical height of the step in the spiral phaseplate is given by $$s = \frac{l\lambda}{(n_1 - n_2)} \tag{3}$$

When the step height is not an integer number of wavelengths, the phase of the beam is discontinuous at the step and this is observed as a break in the ring intensity pattern. Beijersbergen et al. have modelled the detuning of the step height through the tannsition from one Laguerre-Gaussian mode to another (M. W. Beijersbergen, R. P. C. Coerwinkel, M. Kristensen and J. P Woerdman, Optics Comm. 112 (1994)321). In their small-angle approximation, the converter only changes the phase and not the intensity of the beam. The annular intensity pattern arises from the far field diffraction of the beam's screw dislocation. However, the beam produced is not a pure mode, but an infinite superposition of Laguerre-Gaussian modes. The conversion from the $HG_{00}$ to the $LG_0^1$ mode was calculated to be 78% efficient.

Although orbital angular momentum is a property of the beam as a whole, it is useful to consider this in terms of the equivalent angular momentum per photon. Use of a ray optics picture (FIG. 6) allows an understanding of how the orbital angular momentum content of the beam arises from the mode converter.

Considering a ring of radius r, projected on the spiral surface. The angle, $\theta$, of the local azimuthal slope of the spiral surface is given by $$\tan\theta = \frac{s}{2\pi r} \tag{4}$$

A ray parallel to, but a distance r from, the optical axis will be refracted as it emerges from the spiral surface. The deflection angle, $\alpha$, may be found using Snell's Law:

$$n_2\sin(\theta+\alpha)=n_1\sin\theta \tag{5}$$

Before refraction, the beam has a linear momentum of $n_2h/\lambda$ per photon. After refraction, there is a component of linear momentum in the azimuthal direction, $p_{100}$, given by $$p_\phi = n_2\frac{h}{\lambda}\sin\alpha \tag{6}$$

To achieve this there is a transfer of angular momentum, L, between the spiral phaseplate and the beam of light of $$L = rp_\phi = n_2\frac{h}{\lambda}r\sin\alpha \text{ per photon in the beam.}$$

Considering the small-angle case where (4), (5) and (7) reduce to $$\theta \approx \frac{s}{2\pi r}, \tag{8}$$

$$n_2(\theta+\alpha) \approx n_1\theta \tag{9}$$

$$L \approx n_2\frac{h}{\lambda}r\alpha \tag{10}$$

Combining equations (8), (9) and (10) with s set by equation (3) (the condition for a Laguerre-Gaussian mode), the angular momentum exchanged, L, between the light beam and the phaseplate is $$L \approx \hbar\frac{s(n_1 - n_2)}{\lambda} \approx l\hbar \text{ per photon in the beam.} \tag{11}$$

This agrees with the result for Laguerre-Gaussian beams derived from the analysis of Maxwell's equations (L. Allen, M. W. Beijersbergen, R. J. C. Spreeuw and J. P. Woerdman, Phys. Rev. A 45 (1992)8185).

As r becomes small it is less reasonable to approximate $\tan\theta \approx \theta$; the small-angle model fails and the above argument must be repeated with no approximation.

The angular momentum transfer, L, per photon in the beam is given by $$L = h\frac{n_2}{\lambda} r \sin\left(\sin^{-1}\left(\frac{n_1 s}{n_2\sqrt{s^2+4\pi^2 r^2}}\right) - \tan^{-1}\left(\frac{s}{2\pi r}\right)\right) \quad (12)$$

Figure 7:
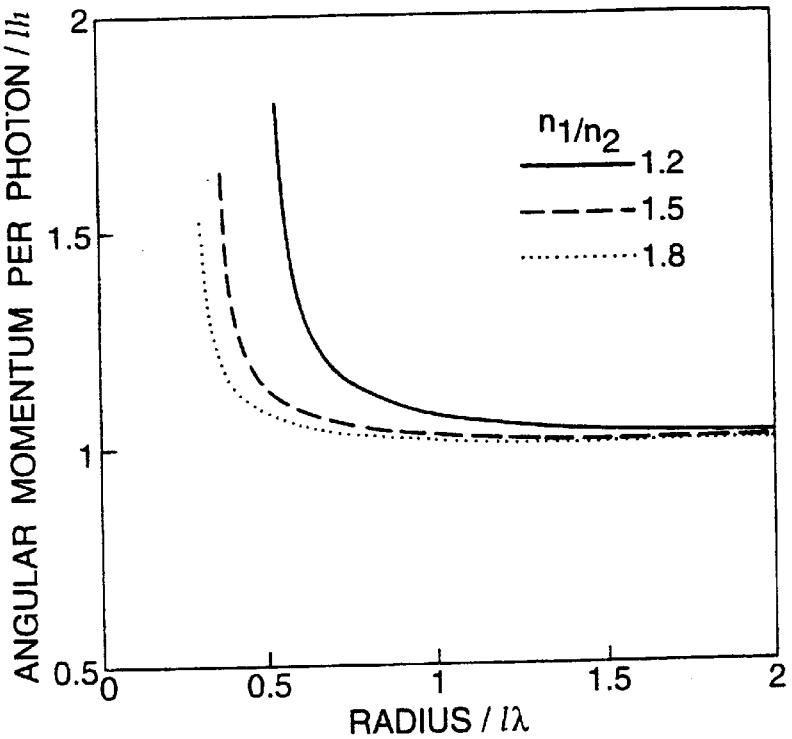
FIG. 7 shows the relationship between the imparted angular momentum per photon to the normalised radius of the mode converter.

FIG. 7 shows equation (12) plotted as a function of radius for different values of $n_1/n_2$. To give a graph independent of l and λ, the angular momentum per photon has units of l h and the radius is in units of lλ. Three points are worthy of note. First, as r decreases, θ eventually reaches the critical angle and total internal reflection prevents the transmission of the beam. Consequently the mode converter alters the intensity at small r.

Second, it follows that L has no value at very small values of r/lλ. Just below the critical angle, L has a maximum value which falls rapidly to unity as r/lλ increases. For our case, where $n_1/n_2$ ~1.5, the small-angle approximation is valid when r>lλ.

Third, as $n_1/n_2$ increases, the radius below which the small-angle approximation breaks down becomes smaller.

These effects are not important in the optical regime, where lλ is small compared with the typical beam radius. They become more important when the wavelength is increased to the millimeter-wave range. It is obviously impractical to scale the beam diameter by the same amount as wavelength and one must be careful to ensure that most of the power is in the small-angle regime.

It follows from (7) that for a fixed step height and constant power, the angular momentum transferred to the beam is independent of the wavelength. Consequently, a spiral phaseplate converter with a step height of a few millimetres may be used to produce an optical beam with a large angular momentum. However, the efficiency of coupling into a single Laguerre-Gaussian mode falls significantly as l increases (M. W. Beijersbergen, R. P. C. Coerwinkel, M. Kristensen and J. P Woerdman, Optics Comm. 112 (1994) 321), hence, the generated beam would not be a pure mode.

Experimental Configuration

FIG. 8 shows an experimental configuration used to produce millimeter wave, free-space, Laguerre-Gaussian modes. The source 10 was an InP Gunn diode oscillator with a peak output power of 10–20 mW. Adjusting the dimensions of the resonant cavity tuned the linearly polarised output from 72 to 95 GHz (G. M. Smith, TEO's at mm-wave frequencies and their characterisation using quasioptical techniques. Ph.D. Thesis, St Andrews (1990)). A circular-aperture, corrugated feed-horn 3 produced a ~98% pure $HG_{00}$ beam with Rayleigh range of 50 mm (R. J.Wylde, Proc IEE, part H, 13 (1984)258). A polyethylene lens 4 of focal length 120 mm collimated the beam with w≈25 mm.

Since w>>lλ, the small-angle approximation is valid in this case. The phaseplate 6 was also made of polyethylene, which has a refractive index of 1.52 at millimeter-wave frequencies (J C G Lesurf, Millimeter-wave Optics, Devices and Systems (Adam Hilger/IOP, 1990)). Two different phaseplates were used, one to generate the $LG_0^1$ mode and the other to generate the $LG_0^2$ mode. The step heights were 6.7 mm and 13.4 mm respectively to give a single and a double wavelength step at 86 GHz. The planar surface of the phaseplate and both surfaces of the collimating lens were cut with an antireflection texture of quarter-wavelength deep concentric grooves.

An aluminium mirror 12 reflected the output from the phaseplate onto a detector 11 mounted on an x-y scanning stage 13 placed in the far field of the converter. The detector 11 used was an Anritsu MP81B/ML83A with an identical feed horn 3 to that on the oscillator. The antenna pattern of the horn is Gaussian in form, and so the measured intensity profile is the convolution of the true far field diffraction pattern and a Gaussian point spread function. The x-y scanning stage and detector were computer controlled to measure a 50×50 grid over a square area with a side of 100 mm. The readings were transferred to *Mathematica* (Wolfram Research, Inc., Mathematica, Version 2.2, Champaign, Ill., USA (1994)), in which they were interpolated and displayed as density plots.

Results

FIG. 9(*a*) shows the result of the conversion from $HG_{00}$ to $LG_0^1$. The central minimum, a characteristic of the Laguerre-Gaussian mode, is well defined. FIG. 9(*b*) shows the corresponding result for the $LG_0^2$ mode. As expected, the radius of maximum intensity of the $LG_0^2$ is $\sqrt{2}$ times that of the $LG_0^1$ (M. J. Padgett and L. Allen, "The Poynting vector in Laguerre-Gaussian laser modes", Optics Comm. (in press)). The linear polarisation state of the Laguerre-Gaussian beams was demonstrated using a wire-grid polariser, with which the beam could be completely attenuated.

This confirms that, unlike previous waveguide-based work in the microwave regions (M. Kristensen, M. W. Beijersbergen and J. P. Woerdman, Optics Comm. 104 (1994)229), there is no combination of the spin polarisation and the orbital angular momentum in this case.

For both of the generated Laguerre-Gaussian modes, "hotspots" were observed in the ring with an increased intensity of about 10%. Two possible sources of these have been modelled. One is an imperfection at the centre of the phaseplate, caused by the finite size of the machining tool; the other is slight misalignment of the axis of the $HG_{00}$ beam and the axis of the phaseplate. The magnitude of the observed "hot-spots" are consistent with the precision of the experimental configuration.

What is claimed is:

1. A method of transmitting radiofrequency radiation over an azimuth angle of substantially 360°, said method comprising:

providing a substantially conical reflector;

illuminating said reflector with a beam having a Laguerre-Gaussian intensity distribution; and locating the minimum of the Laguerre-Gaussian distribution coinciding with the apex of the reflector, wherein the arrangement of the beam and reflector being such that the radiation reflected from the reflector is divergent.

2. A radiofrequency antenna for providing transmission over substantially 360° in azimuth, said antenna comprising:

a conical reflector;

a source of radiofrequency radiation illuminating said reflector, said radiation having a beam directed at the apex of said conical reflector and with a Laguerre-Gaussian intensity distribution, the minimum of the Laguerre-Gaussian distribution coinciding with the apex of the reflector, the beam and the reflector interrelated such that the radiation reflected from the reflector is divergent.

3. The radiofrequency antenna of claim 2 and further including a source of radiation having a Fundamental Hermite-Gaussian intensity distribution and means for converting said radiation to radiation having a Laguerre-Gaussian intensity distribution.

4. The radiofrequency antenna of claim 3 where the means for converting radiation having a Fundamental Hermite-Gaussian intensity distribution comprises a spiral phaseplate.

5. The radiofrequency antenna of claim 4 and further including means for collimating the radiation.

6. The radiofrequency antenna of claim 5 where the means for collimating the radiation having a Fundamental Hermite-Gaussian intensity distribution comprises at least one lens.

7. The radiofrequency antenna of claim 6 and further including means for controlling the angular coverage in elevation of the output radiation of the radiofrequency antenna.

8. The radiofrequency antenna of claim 7 where the means for controlling the angular coverage in elevation of the output radiation of the radiofrequency antenna comprises at least one lens.

9. The radiofrequency antenna of claim 8 where the radiation having a Fundamental Hermite-Gaussian intensity distribution is linearly polarised.

10. The radiofrequency antenna of claim 9 and further including means for converting said linearly polarised radiation to circularly polarised radiation.

11. The radiofrequency antenna of claim 10 where the means for converting said linearly polarised radiation to circularly polarised radiation comprises a quarter wave plate.

* * * * *